United States Patent [19]

Jensen

[11] 4,407,201

[45] Oct. 4, 1983

[54] RETARD SENSOR AND ENERGY CONVERTER

[75] Inventor: Norman E. Jensen, Plymouth, Minn.

[73] Assignee: Honeywell Inc., Minneapolis, Minn.

[21] Appl. No.: 260,242

[22] Filed: May 4, 1981

[51] Int. Cl.[3] ..... F42C 15/24

[52] U.S. Cl. ..... 102/248; 102/255; 102/256; 102/264

[58] Field of Search ..... 102/262, 264, 247, 248, 102/249, 251, 216, 276, 386, 387, 254, 255, 256

[56] References Cited

U.S. PATENT DOCUMENTS

| | | | |
|---|---|---|---|
| 2,486,362 | 10/1949 | O'Brien | 102/264 X |
| 2,710,578 | 6/1955 | Rabinow | 102/247 |
| 2,900,913 | 8/1959 | Sheeley | 102/248 |
| 2,921,524 | 1/1960 | Rabinow | 102/264 X |
| 3,125,958 | 3/1964 | Foure | 102/249 |
| 3,368,487 | 2/1968 | O'Connor et al. | 102/264 |
| 3,382,803 | 5/1968 | Swallow et al. | 102/387 X |
| 3,425,353 | 2/1969 | Halling | 102/387 X |
| 3,906,861 | 9/1975 | Hamilton et al. | 102/249 |
| 4,337,701 | 7/1982 | Janson | 102/264 |

*Primary Examiner*—David H. Brown
*Attorney, Agent, or Firm*—George W. Field

[57] ABSTRACT

The method of performing an arming operation in a falling munition which comprises the steps of decelerating the munition, quickly converting a portion of the energy of deceleration to potential energy, and slowly utilizing the potential energy to perform the arming operation.

3 Claims, 9 Drawing Figures

FIG. 2
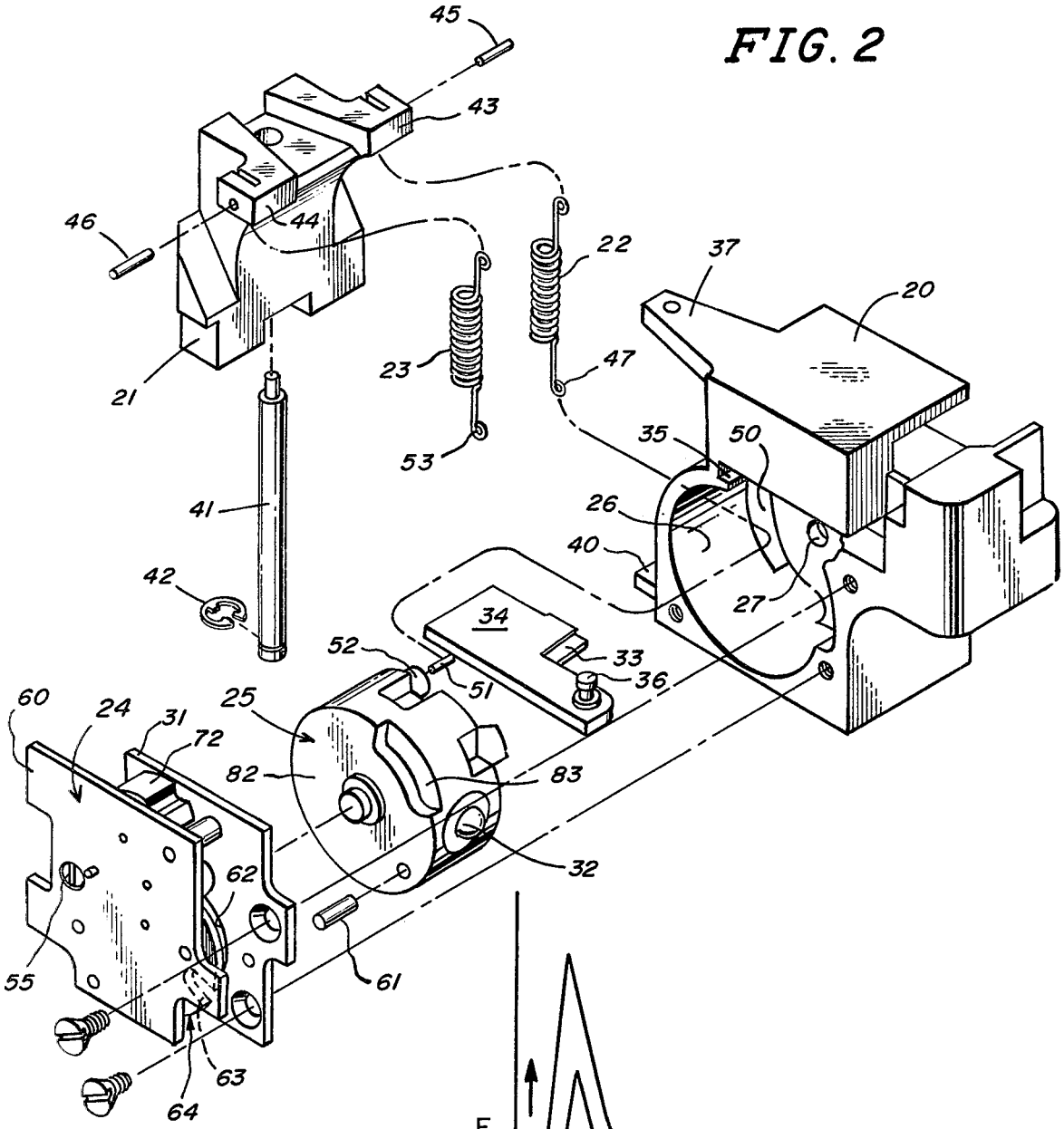
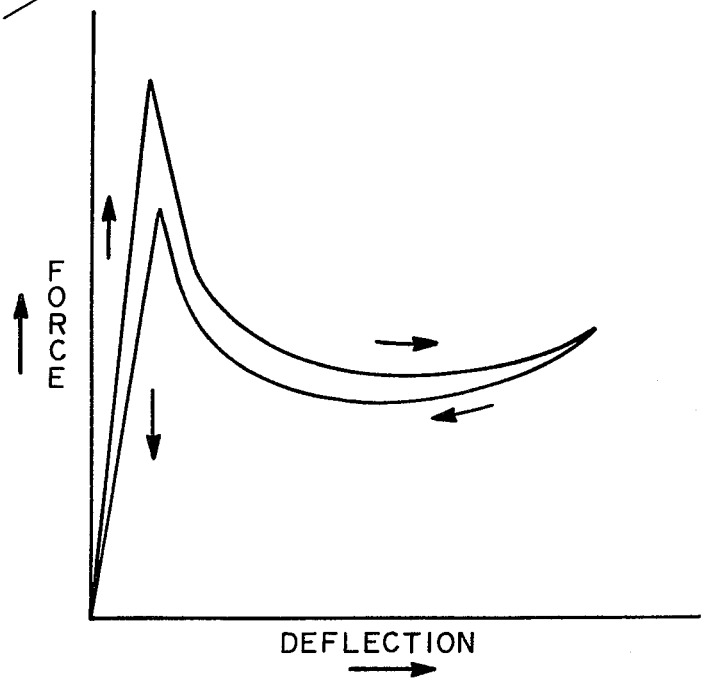
FIG. 9

FIG. 3
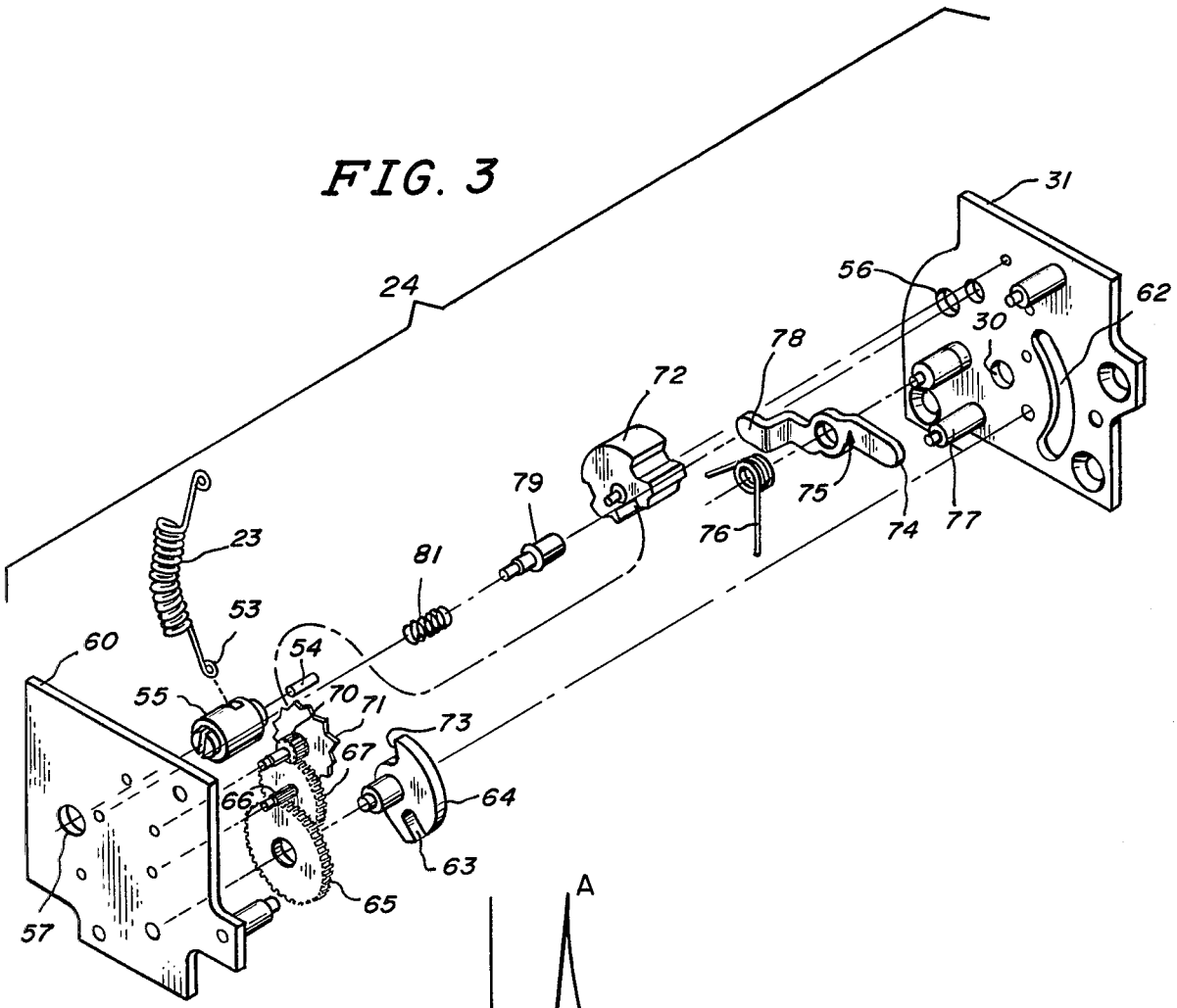
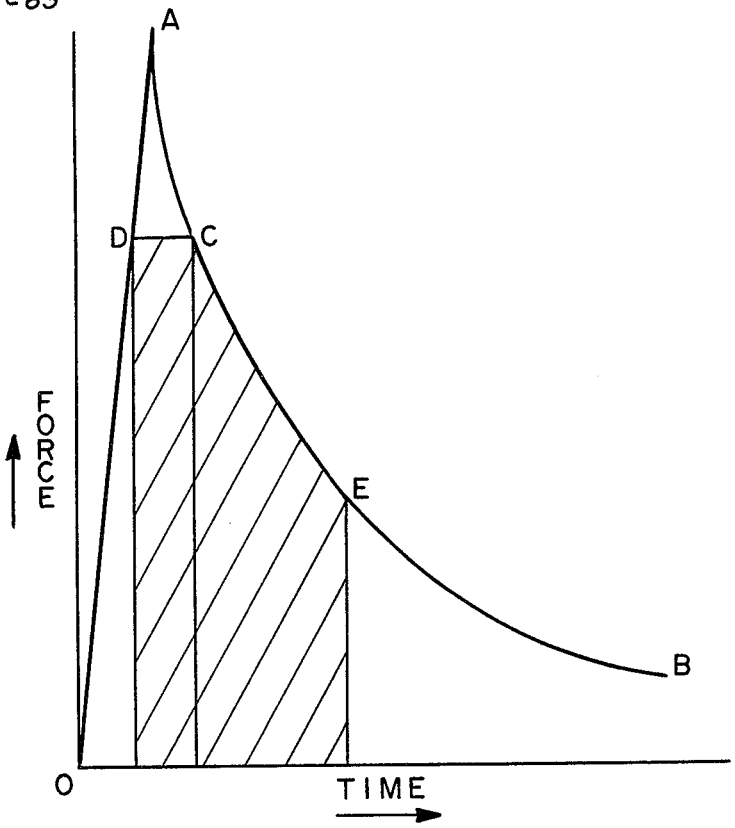
FIG. 8

RETARD SENSOR AND ENERGY CONVERTER

The invention herein described was made in the course of or under a contract, or subcontract thereunder, with the Department of the Air Force.

TECHNICAL FIELD

This invention relates to the field of munitions, and particularly to apparatus for sensing a velocity change associated with retardation of a free-falling munition, and deriving therefrom energy for a fuze arming operation.

BACKGROUND OF THE INVENTION

There is a class of munitions which are dispensed from over-flying aircraft and saved from force of impact with the ground by individual parachutes which open after the munition is safely clear of the aircraft. The munitions are finally armed upon impact, but for safety it is desirable to disable the arming circuit until the munition is free from the aircraft, and an arm enable function is performed when the parachute opens and retards the fall of the munition for an interval of considerable duration.

BRIEF SUMMARY OF THE INVENTION

The invention comprises a pre-arming rotor coupled to an excapement and connected to an inertial mass by a flexing spring which drives the rotor in the arming direction, at a speed determined by the escapement in response to retardation of the munition. A second flexing spring resets the mass and rotor to initial conditions if the retardation does not continue for the full pre-arming period of the rotor.

Various advantages and features of novelty which characterize the invention are pointed out with particularity in the claims annexed hereto and forming a a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawing, in which like reference numerals indicate corresponding parts throughout the several views.

FIG. 2 is an exploded view of the device of FIG 1;

FIG. 3 is an exploded view of a portion of FIG. 2;

FIG. 8 is a diagram of a retardation profile typical for the invention;

FIG. 9 is a force versus deflection diagram for springs used in the invention.

DESCRIPTION OF THE PREFERRED EMBODIMENT

Figure 1:
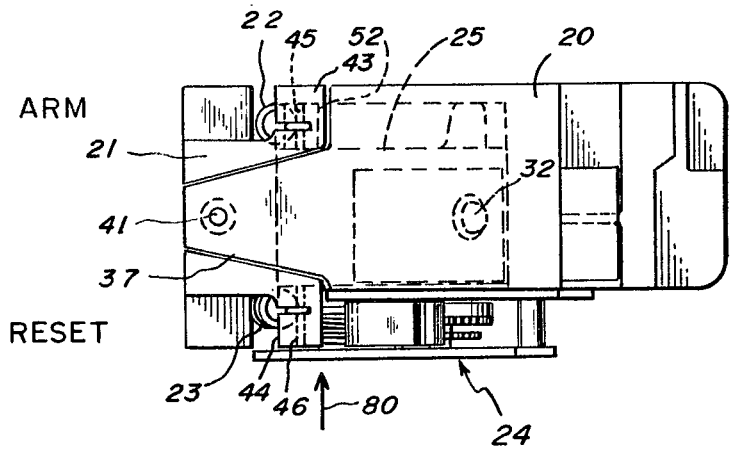
FIG. 1 is a plan view of a device according to the invention.

The principal components of the device as shown in FIG. 1 are a base or housing 20, an inertial mass 21, an arming spring 22, a reseting spring 23, and escapement 24, and a rotor 25 better shown in FIG. 2, to which reference should now be had.

Rotor 25 is mounted in a cavity 26, in housing 20, which is closed by escapement 24: the rotor is pivoted in an aperture 27 in housing 20 and an aligned aperture 30 in one plate 31 of escapement 24. The rotor carries a first electrical contact 32 which may move into engagement with a fixed contact 33 carried by an insulating strip 34 received in a groove 35 in housing 20. A terminal 36 enables electrical connection to be made with contact 33: contact 32 is grounded.

Housing 20 has an upper lip 37 and a lower lip 40 in which a cylindrical rail 41 is secured by a fastener 42. Inertial mass 21 slides on rail 41 and has ears 43 and 44 to which first ends of springs 22 and 23 are pivotally secured on pins 45 and 46. The second end 47 of spring 22 passes through a slot 50 in housing 20 and is pivotally secured on a pin 51 projecting from a boss 52 on rotor 25 in a direction parallel to the axis of rotation of the rotor.

FIG. 3 shows that the second end 53 of spring 23 is pivotally mounted on a pin 54 positioned eccentrically in a cam cylinder 55 pivoted in apertures 56 and 57 in plates 31 and 60 of escapement 24.

Springs 22 and 23 are not used either in conventional compression or conventional extension, but are of the type commercially reffered to as "Flexator" springs and described in U.S. Pat. No. 2,630,316, and are used in a flexing mode.

Figure 4:
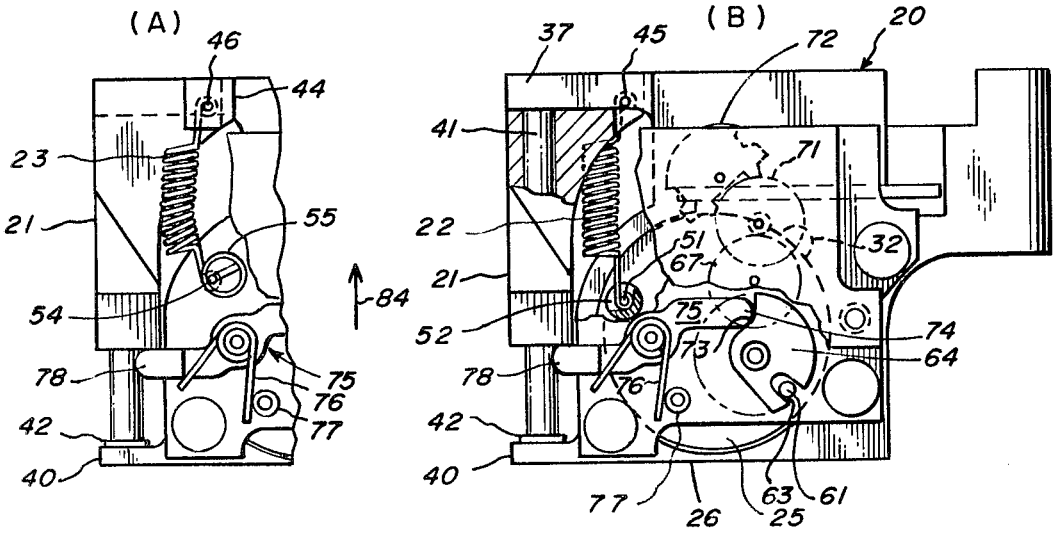
FIGS. 4–7 are partly schematic views in elevation, parts being shown in phantom or broken away, to explain the operation of the invention.

A drive pin 61 extends from rotor 25 through a arcuate slot 62 in escapement plate 31 into a radial slot 63 in a cam 64 pivoted in plates 31 and 60 and connected through gear 65, pinion 66, gear 67, and pinion 70 to an escapement wheel 71 co-acting with a pivotally reciprocating eccentric weight 72, to act as an escapement controlling the rotation of cam 64 about its axis. Cam 64 is configured with a stop surface 73 engageable by one end 74 of a lock lever 75 pivoted in plates 31 and 60 and normally urged by a spring 76, acting against a stud 77, into engagement with surface 73 to prevent rotation of cam 64 in a counter clockwise direction as seen in FIG. 4. The other end 78 of lever 75 projects into the path of inertial mass 21. A detent 79 in escapement 24 is urged by a spring 81 into engagement with one face 82 of rotor 25, and may move into an arcuate groove 83 in the rotor in a particular range of rotation thereof.

OPERATION

The operation of the device will now be described, further reference being had to FIGS. 4, 5, 6, and 7. All of these figures are viewed in the direction of arrow 80 in FIG. 1, and in each figure view A is a direct view of the device, while view B is partially broken away and somewhat schematic, to show the relation of various parts, some being in phantom.

The device is mounted in the munition with the rail 41 parallel to the direction in which deceleration or retardation will occur. It is known for such munitions to have a drogue parachute which is initially deployed to orient the munition with rail 41 vertical, but which does not materially retard the missile. After an appropriate interval a main parachute deploys. The retardation profile has an initially sharp rise in G level, followed by an exponential decay over several seconds.

Before main parachute deployment, spring 23 is generally as in FIG. 4A, and spring 22 is generally as in FIG. 4B. The latter spring is not applying torque through pin 51 to cause a rotation of rotor 25, and the former is applying a minimal force between pins 46 and 54 determined by the rotation of cam cylinder 55, which is staked in position after an initial setting. Mass 21 is in line with end 78 of lever 75, end 74 of which is held by spring 76 against stop surface 73 of cam 64 to prevent cam rotation, and hence to prevent both rotation of rotor 25 and operation of excapement 24. Contacts 32 and 33 are widely separated. Dispensing of the munition from an aircraft into free-fall, and deployment of the drogue parachute to orient rail 41, produce no significant change in the device.

Figure 5:
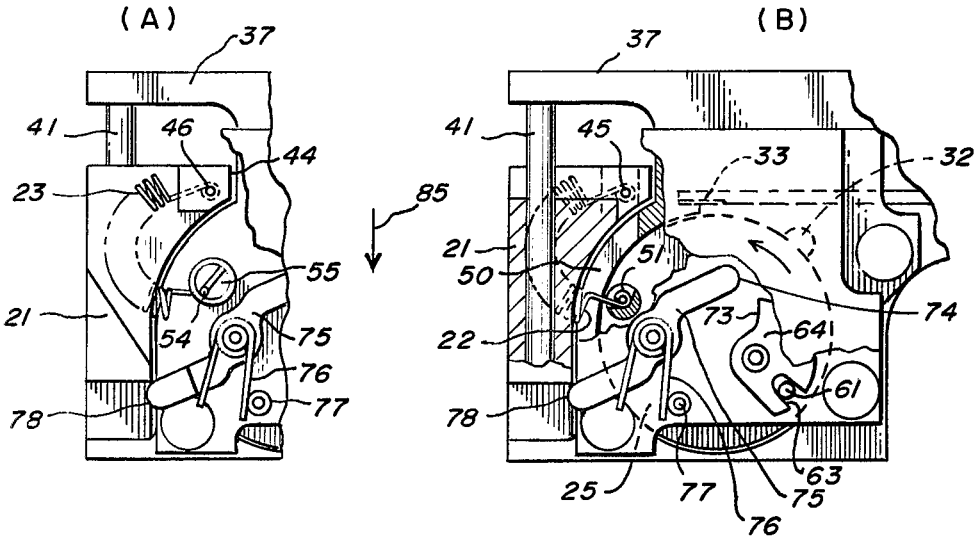

When the main parachute opens, deceleration, or retardation, acts in the direction of arrow 84 in FIG. 4, and inertial force causes mass 21 to move in the direction of arrow 85 in FIG. 5. This changes the configuration of springs 22 and 23 as shown, in effect converting a portion of the kinetic energy of deceleration to potential energy stored in the springs. In their new configurations spring 23 acts upwardly against pin 46, and spring 22 applys a torque to pin 51 to cause clockwise rotation of the rotor. In its downward movement mass 21 engages the end 78 of lever 75, acting against spring 76 to life end 74 of the lever out of engagement with surface 73. This allows rotor 25 to act through pin 61 to rotate cam 64 about its axis, the rotation being regulated by the escapement through members 72, 71, 70, 67, 66, and 65, and the energy for rotation being supplied by spring 22.

Figure 6:
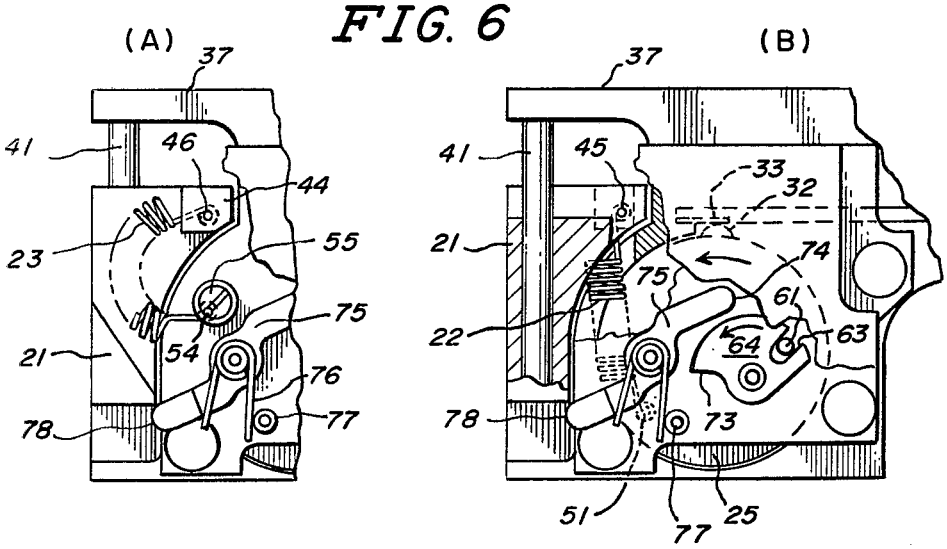

If the deceleration continues during a sufficient interval, rotor 25 continues to rotate, in a counter-clockwise direction, until contact 32 engages contact 33 as shown in FIG. 6, and the pre-arming of the munition is complete. At this time detent 80 enters groove 83, to prevent reverse rotation of the rotor by the reset arrangement, which will now be described.

Figure 7:
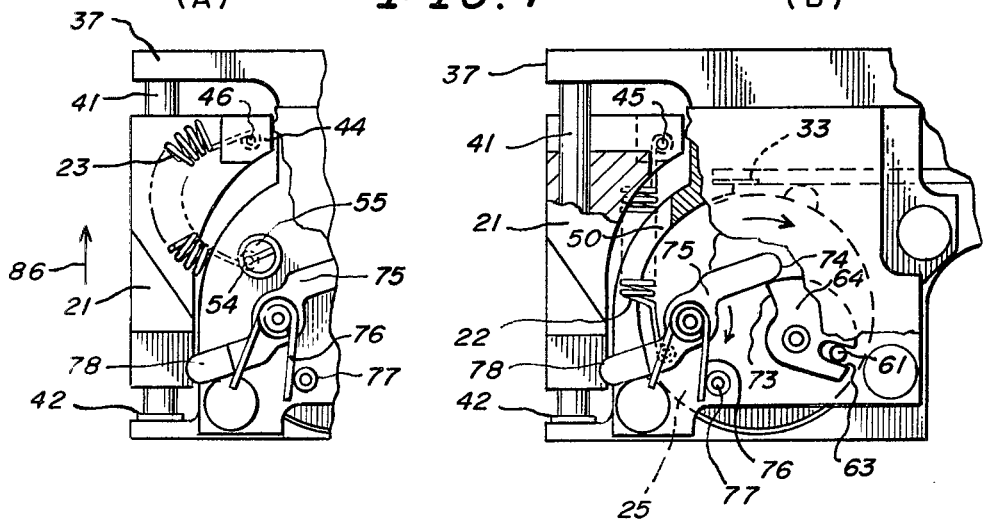

Consider the situation when the munition such as that under consideration is handled roughly, by being dropped, for example. The inertial effect of this is the same as the retardation for which the device is designed, and may even be greater in initial magnitude, so that the mechanism may pass from the state of FIG. 4 to that of FIG. 5 rotor 25 beginning to move toward its pre-armed contacting stage. However, as shown in FIG. 7 as soon as the temporary deceleration ceases, spring 23 acts between pins 54 and 46 to move mass 21 upwardly toward its initial position, as indicated by arrow 86 in FIG. 7. This reverses the direction of the torque applied by spring 22 to rotor 25 at pin 51, and cam 64 is rotated in the opposite direction, escapement 24 being bi-directional, until end 74 of lever 75 can engage cam surface 73, so that the munition is restored to its initial condition, being secure for storage yet ready for dispensing.

Reference should now be had to FIG. 8 which shows the particular advantage of flexing springs in this application. The curve OAB is a typical retardation profile to be encountered by the munition. Typical devices using conventional springs reset at about the same retardation level, point C, as that at which they initiate, point D. The present device does not reset until the retardation has become about half of the initial activation value—that is, at point E. This is because of the peculiar force—deflection diagram of flexing springs shown in hysteresis form in FIG. 9.

From the foregoing it will be evident that the invention comprises a device including flexing springs for initiating pre-arming of a munition in response to a retardation of predetermined magnitude, completing the pre-arming using energy obtained from the retardation if it continues for a predetermined interval, but resetting the munition to its initial condition if the retardation does not continue for the necessary interval.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. In combination:

a housing;

a rotor mounted for rotation in said housing;

means for performing an arming function in a predetermined rotated position of said rotor;

an escapement connected to said rotor for regulating the rotation thereof;

lock means normally disabling said escapement so as to hold said rotor in an initial position displaced from said predetermined position;

an inertial mass movable linearly between an initial position and a second position in which it disables said lock means.

and resilient means connecting said rotor to said mass for causing rotation of said rotor toward said predetermined position, comprising a flexing spring pivotally connected to points on said rotor and said housing which become closer together as said mass moves from said initial position so as to cause flexing of said spring.

2. A combination according to claim 1 further including second resilient means opposing movement of said mass from said initial position, comprising a flexing spring pivotally connected to a point on said mass and to a point radially displaced from the axis of rotation of said rotor, said points lying on a line which does not pass through the said axis.

3. Munition arming apparatus comprising, in combination:

a first fixed contact;

a second contact effective upon engagement with said first contact to perform an arming function;

a rotor carrying said second contact for movement into engagement with said first contact;

an initial mass linearly moveable between first and second position;

flexing spring means connected to said mass in said rotor for causing rotation of said rotor in a first direction when said mass is in said first position, and in a second direction when said mass is in said second position;

latch means normally preventing rotation of said rotor in said first direction; and means disabling said latch means when said mass is in said second position.

* * * * *